US005092092A

United States Patent [19]

Kiekens et al.

[11] Patent Number: 5,092,092

[45] Date of Patent: Mar. 3, 1992

[54] AUXILIARY MEMBER FOR INSULATED CAVITY WALLS

[75] Inventors: Geert E. Kiekens, Betschdorf; Guy van Nuijs, Boechout, both of Belgium

[73] Assignee: The Dow Chemical Company, Midland, Mich.

[21] Appl. No.: 637,727

[22] Filed: Jan. 7, 1991

Related U.S. Application Data

[63] Continuation of Ser. No. 322,794, Mar. 13, 1989.

[51] Int. Cl.[5] ..... E04B 1/62

[52] U.S. Cl. ..... 52/403; 52/746; 52/407

[58] Field of Search ..... 428/31, 41, 703; 52/204, 203, 773-775, 407-412, 405, 406, 746, 403

[56] References Cited

U.S. PATENT DOCUMENTS

| | | | |
|---|---|---|---|
| 1,959,176 | 5/1934 | Rau | 52/169.11 |
| 2,024,524 | 12/1935 | Jones | 52/566 |
| 2,280,389 | 4/1942 | Eiwards | 52/407 |
| 2,642,632 | 6/1953 | Savage | 52/775 |
| 2,841,836 | 7/1958 | Watson | 62/775 |
| 2,887,733 | 5/1959 | Kice | 52/407 |
| 3,881,292 | 5/1975 | Porter | 277/227 |
| 4,311,317 | 1/1982 | Bartels | 277/207 A |
| 4,653,241 | 3/1987 | Bindi | 52/204 |

FOREIGN PATENT DOCUMENTS

| | | | |
|---|---|---|---|
| 244041 | 12/1965 | Austria | 52/574 |
| 344380 | 7/1978 | Austria . | |
| 8303106 | 9/1983 | Netherlands . | |
| 1517966 | 7/1978 | United Kingdom . | |
| 2171143A | 8/1986 | United Kingdom . | |

*Primary Examiner*—James L. Ridgill, Jr.

[57] ABSTRACT

This invention relates to a flexible compressible sealing profile having thermal insulating properties for use in cavity wall construction. This profile comprises essentially an L-shaped cross-section, which is adapted to be compression fit into the cavity wall. The profile can be utilized as both the top and bottom of cavity walls, as well as around doors and windows in order to prevent convectional heat losses from occurring.

9 Claims, 4 Drawing Sheets

AUXILIARY MEMBER FOR INSULATED CAVITY WALLS

This is a continuation of copending application Ser. No. 322,794 filed Mar. 13, 1989 titled "Auxiliary Member For Insulated Cavity Walls".

This invention relates to an elongate air sealing member made from a flexible, compressible, water repellant material having, inter alia, thermal insulating properties. More particularly, this invention relates to an auxiliary insulating profile for installation in a cavity wall.

In certain types of building construction, known as insulated, cavity wall construction, it is customary to have a construction comprising an outer wall, an air gap or cavity that is eventually vented, and an inner wall. Such a construction usually includes insulation boards or insulation materials applied to the inside cavity wall in such a manner that a venting space remains between the insulating boards and the outer wall. It has been shown that natural convection, meaning thermal air circulation, causes substantial heat losses around insulation layers and/or insulation boards, as compared to calculated theoretical values.

Thus, in order to obtain a proper thermal insulated cavity wall, adequate steps must be taken to prevent natural convection from occurring. This requires that the insulation boards fit tightly together so as to form an airtight shield. Openings of only a few millimeters in width can create natural convection currents with corresponding substantial heat losses.

Even more important, however, is to be able to seal all openings around the top and bottom edges of insulation layers, around wall openings and vertical corner connections of cavity walls, so as to prevent normal air infiltration and thermal convection from occurring.

In practice, the inner wall is normally not smooth at its cavity side, i.e. there are projecting cement residues and brick dimensional tolerances which prevent insulating boards from coming to rest perfectly against the inner-wall. Furthermore, the top and bottom edges of insulation layers are normally not sealed in an airtight manner with other building parts. Therefore, it is clear that in order to obtain proper thermal insulation, it is necessary to take extra precautions and work very accurately, which is time-consuming and hence an expensive way of building an insulated, cavity wall construction.

It is an object of this invention to provide an auxiliary member or cavity sealing profile for use in insulated cavity wall construction that is simple to use, and that prevents the circulation of air via natural convection around the insulating layer. It is a further object of this invention to provide a method of insulating cavity walls, which utilizes the cavity sealing profile of this invention.

The auxiliary member comprises essentially an L-shaped cross section of a flexible, compressible, water repellant material having thermal insulation properties. Such a profile is adapted to fit against the butt edge of an insulating board. Other types of L-shaped profiles can be employed to accommodate insulating boards having tongue-and-groove edges, or ship-lapped edges. L-shaped profiles containing various other minor modifications can also be employed to accommodate the edges of specially formed insulating boards, and these are contemplated as falling within the spirit and scope of the present invention.

It is clear that any flexible, compressible, water repellant material having thermal insulating properties can be employed in the practice of this invention. Such materials include, for example, synthetic foams made from polyethylene, polypropylene, polyurethane, ethylene vinyl acetate, polyvinyl chloride, polystyrene and the like, both extruded and expanded. Preferably, elastic, closed-cell, crosslinked and non-crosslinked polyolefin foams are employed.

Still more particularly, cavity sealing profiles comprising closed-cell, non-crosslinked polyethylene foam or mixtures containing such foams are utilized in the present invention. These materials have very good thermal insulating properties, are not susceptible to hydrolysis and absorb practically no water. Moreover, such polyethylene foam materials are resilient and can absorb the tensile and compressive stresses arising from temperature fluctuations or load pressures. Due to their resilience they are able to deform under stress and pressure and thereby fit tightly into a cavity wall without cracking. Thus, cavity sealing profiles made from such materials form a tight compression fit within the cavity that effectively prevents any heat losses from occurring via thermal convection.

The desired profiles can be milled to shaped from block foam, molded to shape, or extruded to shape through special dies. However prepared, the cavity sealing profile is adapted to be placed in the cavity of the wall in such a manner that the outer longitudinal face of the vertical member of the L-shaped profile is adjacent to the inner surface of the exterior wall, while the longitudinal edge of the horizontal limb of the L-shaped cavity sealing profile is adjacent to the inner cavity surface of the interior wall.

One advantage of the cavity sealing profile or auxiliary profile described herein is in the construction of the cavity wall itself. In some countries, both inner and outer cavity walls are progressively constructed at the same time. By seating the auxiliary profile at the base of the cavity of the cavity wall, it forms a spacer between the inner and outer walls, thereby providing and maintaining a proper cavity width. At the same time, the auxiliary profile helps to prevent cold bridges from occurring at connections between insulation surfaces and other construction parts. Furthermore, as a construction aid, once the longitudinal surface of the horizontal limb of the cavity sealing profile is plumb and level, insulation boards subsequently added thereto will also automatically be level. Once the top of the cavity wall is reached, a second cavity sealing profile is attached which is in opposition to the base cavity sealing profile, thereby effectively sealing all air leaks both at the bottom and at the top of the cavity. Obviously, additional cavity sealing profiles can be installed at verticalcorners and around wall openings, such as doors and windows.

In addition to the other functions previously mentioned, the cavity sealing profiles of the present invention can serve to discharge any condensate or rain water that may occur in the cavity between the insulating layer and the inner surface of the exterior wall. In a preferred embodiment of the present invention, the top surface of the cavity sealing profile, is sloped downwardly to the exterior wall. Thus, the inclined top surface conducts any water or condensate towards the direction of the external wall. The water and condensate can be easily discharged via openings provided near the lowest point of the inclined top surface leading to the exterior of the outer wall.

For an even more effective discharge of cavity wall condensate or rain water that might collect within the cavity, a moisture-proof, tear resistant, flexible film can be employed which serves as a condensate or water barrier. As a preferred embodiment such a film is made to adhere to the sloping surface of the cavity sealing profile. The top edge of this film is secured to the exterior surface of the insulation board, whereas the bottom edge of this film leads to the outside of the exterior wall via a horizontal joint in the outer wall. Such a film effectively serves as a water impermeable barrier and conduit to the exterior surface of the outer wall for any rainwater or condensate that finds its way inside the cavity wall. The top of this film can be conveniently secured to the exterior surface of the insulation boards by passing the film through a horizontal joint of the insulation layer in such a manner as not to disturb the air tightness of the joint.

Any type of moisture proof film can be utilized in connection with this invention. Due to the hard usage to which such a film is subjected during construction, it is desirable to employ a film of sufficient thickness so as to be tear and puncture resistant, but which still retains its flexibility. Cast or blown films made from linear low density polyethylene resins are particularly useful in the practice of this invention. They exhibit exceptional tear, toughness and puncture resistant properties and are completely water resistant. The film can be so attached to the auxiliary profile that it allows a horizontal overlap which can be either a loose-laid overlap or which can be sealed together at the job site.

Some embodiments of the present invention will now be described, by way of example, with reference to the accompanying drawings, in which.

Figure 1:
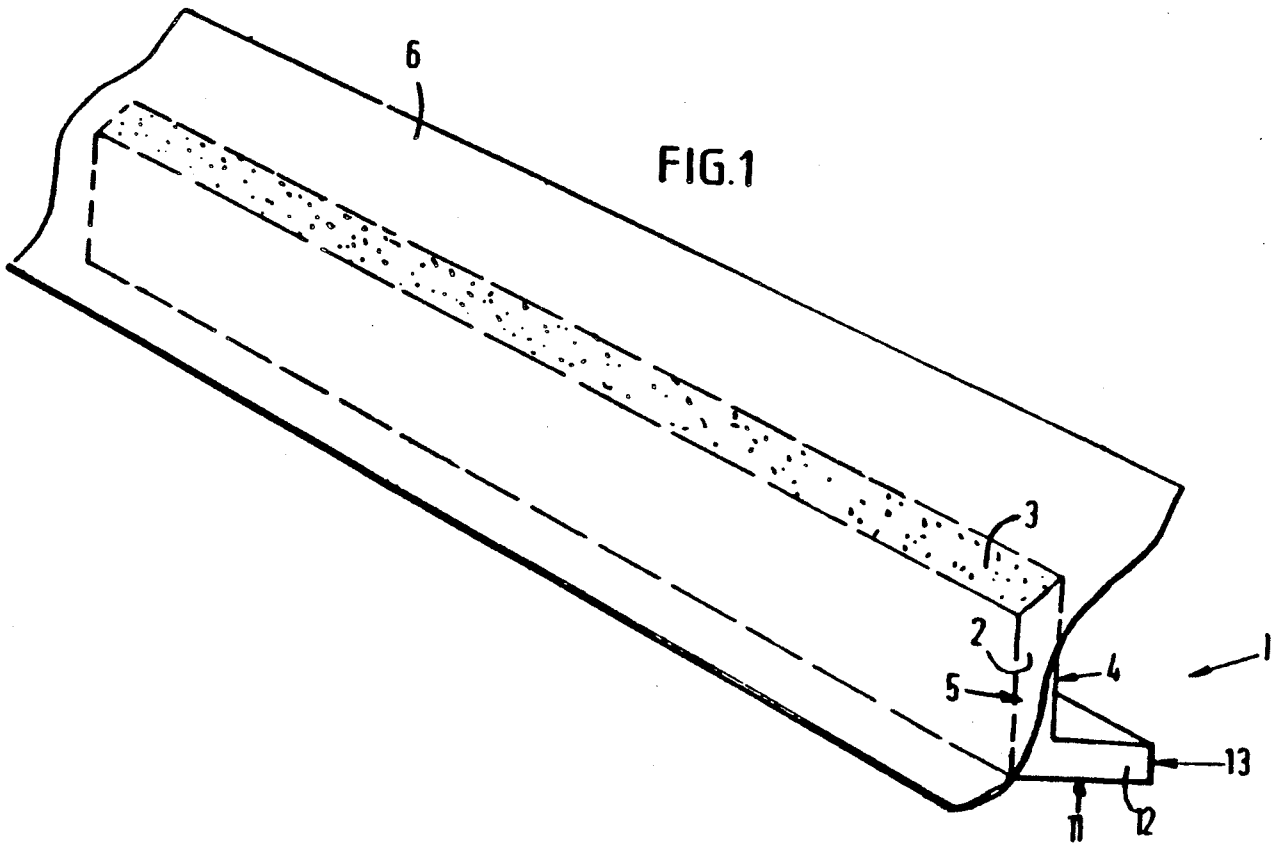
FIG. 1 is a perspective view of an elongate cavity sealing profile in combination with a moisture-resistant sheet material.

One embodiment of an elongate cavity sealing profile (1) is shown in FIG. 1, which has a substantially L-shaped cross section, and which is made from a flexible, compressible material having thermal insulating properties. The free end of the vertical limb (2) of the L-shaped cavity sealing profile (1) has a top surface (3) extending obliquely downwards from its inner longitudinal face (4) to the direction of its outer longitudinal face (5). A moisture-resistant, film material (6) may be fixed to the top sloping surface (3), said film being of sufficient length so as to substantially extend beyond the top and bottom edges of the sloping surface (3).

Figure 2:
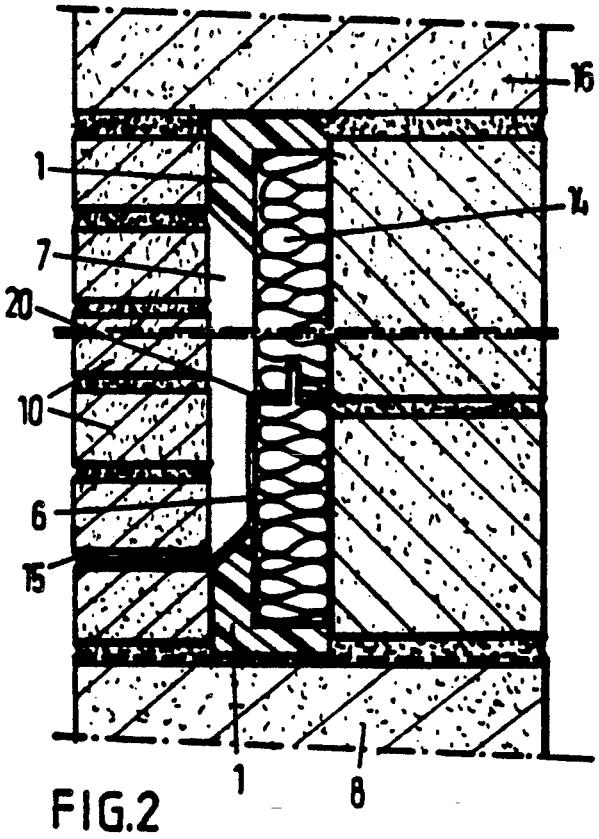
FIG. 2 is a cross-sectional view of a cavity wall construction, showing the placement of an insulation member between two cavity sealing profiles of FIG. 1.

As shown in FIG. 2, the cavity sealing profile (1) is adapted to be compression fit into the base of the cavity (7) of a cavity wall (9, 10). The bottom longitudinal face (11) of said profile rests on the foundation (8) or the base of the cavity (7), while the outer longitudinal face (5) is adjacent to the inner surface of the exterior wall (10). The longitudinal edge (13) of the horizontal limb (12) rests adjacent to the inner surface of the interior wall (9). Between the inner longitudinal face (4) of the sealing profile (1) and the cavity side of the inner wall (9), a part of an insulating board (14) is adapted to be confined therein. It is clear that the sealing member (1) should be of such a length as to seal the entire length of the cavity wall.

The inclined top surface (3) of the cavity sealing profile (1) is designed so as to collect any rain water or moisture condensate present in the cavity (7), and discharge it to the outside of the exterior wall (10). Preferably, the sealing profile (1) is positioned in such a manner that the lowest point of the top surface (3) is flush with a horizontal joint (15) formed by two rows of bricks in the exterior wall (10).

For the effective discharge of water, the moisture-proof, tear resistant, flexible film (6) is affixed to the top surface (3) of the cavity sealing profile (1). The top edge of this film can be readily held in place by passing it through a joint (20) formed between two insulation boards (14), care being taken not to disturb the air tightness of the joint. The lower edge of the film can be sloped downward and led to the exterior via a horizontal joint (15). The top of the cavity wall can be enclosed by reversing the cavity sealing profile so that the longitudinal face (11) of said profile (1) is adjacent to the ceiling (16).

Figure 3:
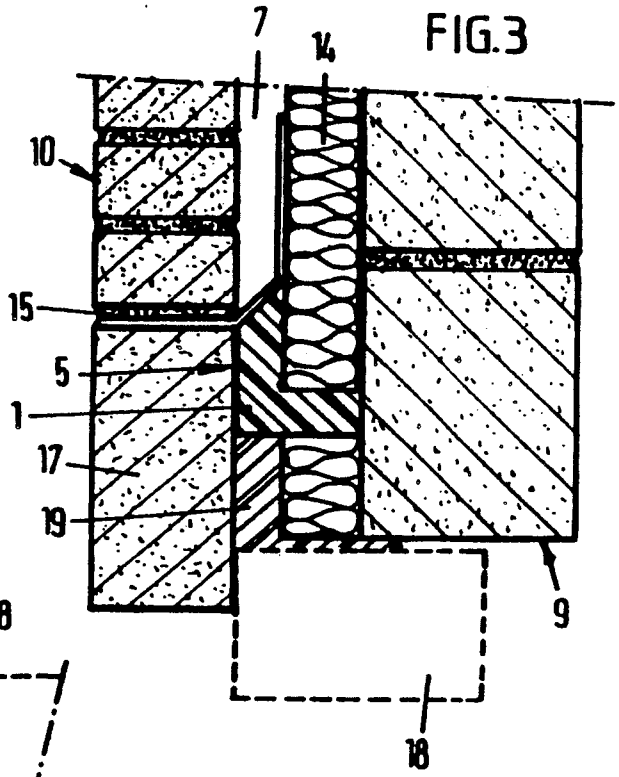
FIGS. 3 and 4 represent vertical and horizontal cross-sections, respectively, of a cavity wall located around a window or door, provided with an insulating member contained by a cavity sealing profile of FIG. 1.
Figure 4:
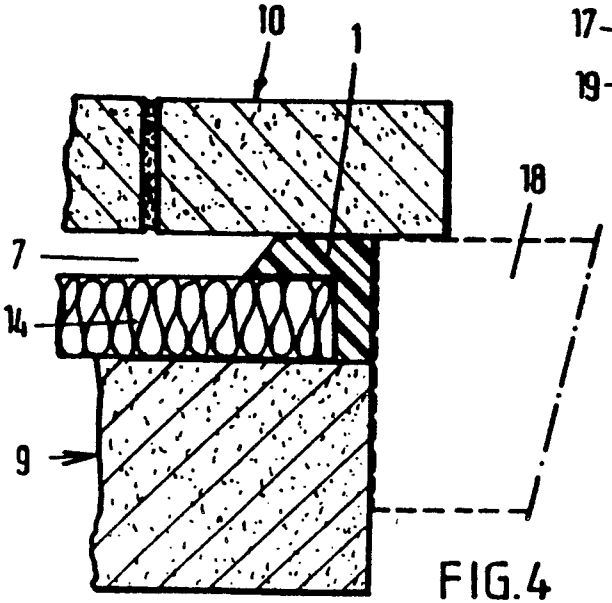

FIGS. 3 and 4 show a vertical and horizontal cross section of a cavity wall adjacent to a window or door opening, and shows how the cavity sealing profile (1) can be mounted in such a case. FIG. 3 shows the use of a course of brick or stone laid on edge (17), and the placement of the sealing profile (1) at the appropriate height against the inner face of said course of brick or stone. Such techniques, can be utilized, for example, when said edge (17) is a lintel or ornamental supporting structure of natural stone, having a larger vertical dimension than the outer longitudinal face (5) of the cavity sealing profile. Again the vertical joints between the lintel and superposed brick function as an outlet channel for any moisture or water the cavity may receive. The cavity formed between the frame (18) and the bottom longitudinal face (11) of the sealing member (1) can be be filled with an insulation member (14) and then with an expandable foam or soft insulation material (19). In the vertial portion of the wall (see FIG. 4), the cavity sealing profile can be placed against the frame (18) without objection, since its positioning near a joint is not necessary in the vertical plane.

Figure 5:
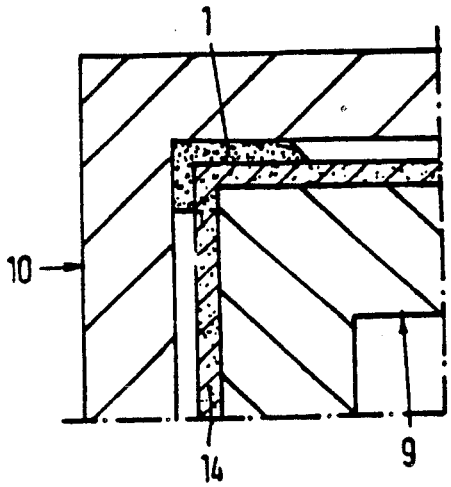
FIG. 5 is a horizontal cross-sectional view of a corner of a cavity wall, provided with insulating members that are contained by a cavity sealing profile.

FIG. 5 shows an embodiment of how a cavity sealing profile (1) can function as a cavity sealer in the situation where the external walls are set at right angles to each other. Such a positioning of the sealing profile results in effectively sealing any gaps created by improperly fitting insulating boards. Since even small gaps of one or two millimeters can create thermal convection with resulting heat loss, the use of a cavity sealing profile to seal a corner joint is a further advantage of the present invention.

Figure 6:
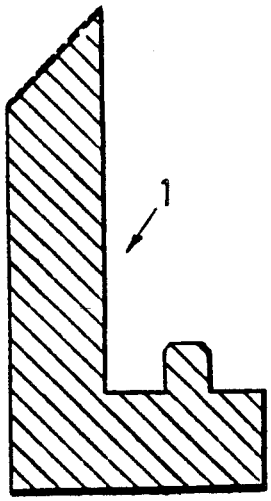
FIGS. 6 and 7 show vertical cross-sections of two variations of the cavity sealing profile of FIG. 1.
Figure 7:
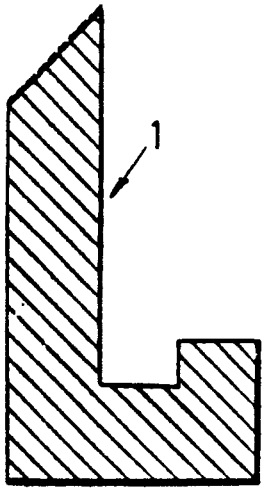

FIGS. 6 and 7 show two cross sectional variations of the sealing profile (1). In particular, FIG. 6 demonstrates the cross-section view of a cavity sealing profile adapted to accommodate insulating boards capable of forming tongue-and-groove joints. In this embodiment, the ridge on the horizontal limb is adapted to receive the end of an insulating board adapted for forming a tongue-and-groove joint and thereby forms a tongue-and-groove joint with such insulating board. FIG. 7 illustrates the cross-section view of an embodiment of the invention wherein the cavity sealing profile is adapted to accommodate insulating boards capable of forming ship-lapped joints. The ridge at the end of the horizontal member thus forms a ship-lapped joint with an insulating board adapted for forming ship-lapped joints and thus the cavity sealing profile and the insulating board form a ship-lapped joint. The ridged horizontal limb ensures that the edges of the insulation board (14) having a complementary profile, fit snugly and remains air tight. The fact that the cavity sealing profile can be slightly deformed when the edge of the insulation board is pressed against the L-shaped surface of the cavity sealing profile ensures a tight fit. The result is that excellent sealing is obtained and no undesirable air circulation or thermal convection occurs between the inner surface of the interior wall and the insulation boards.

It is clear that, without departing from the scope of the present invention, modifications can be made for instance as regards the profile of the sealing member. Likewise, the sealing member can be used between any two spaced-apart walls to prevent undesirable air circulation or convection from occurring.

We claim:

1. An elongate cavity sealing profile comprised of a flexible compressible synthetic foam of polyethylene, polypropylene, polyurethane, ethylene, vinyl acetate, polyvinyl chloride, or polystyrene having thermal insulating properties wherein the sealing profile is characterized by having a longitudinal horizontal limb having an outer longitudinal face, an inner longitudinal surface, and a longitudinal edge; and a longitudinal vertical limb having an outer longitudinal face, an inner longitudinal face, and a longitudinal top face; wherein the vertical longitudinal limb and the horizontal longitudinal limb are integrated to form a substantially L-shaped cross-section, wherein the longitudinal horizontal limb and the longitudinal vertical limb have sufficient thickness to demonstrate insulating properties, wherein the cavity sealing profile is adapted to fit against the butt end of an insulating board and to prevent the circulation of air via natural convection around the insulating board.

2. An elongate cavity sealing profile comprised of a flexible compressible synthetic foam of polyethylene, polypropylene, polyurethane, ethylene, vinyl acetate, polyvinyl chloride, or polystyrene having thermal insulating properties wherein the sealing profile is characterized by having a longitudinal horizontal limb having an outer longitudinal face, an inner longitudinal surface, and a longitudinal edge; and a longitudinal vertical limb having an outer longitudinal face, an inner longitudinal face, and a longitudinal top face; wherein the vertical longtudinal limb and the horizontal longitudinal limb are integrated to form a substantially L-shaped cross-section, wherein the longitudinal horizontal limb and the longitudinal vertical limb have sufficient thickness to demonstrate insulating properties.

3. An elongate cavity sealing profile as claimed in claim 2 characterized in that the top face of said profile extends obliquely downwards from its inner longitudinal face to its outer longitudinal face.

4. An elongate cavity sealing profile according to claims 2 or 3 characterized in that said profile is provided with a moisture-proof, tear resistant, flexible film, which is fastened to the top face of the vertical limb of said profile, said film extending in both directions beyond the top face of said profile.

5. An elongate cavity sealing profile in accordance with claims 2, 3 or 4, characterized in that the top surface of the horizontal limb of said profile is in the form of a tongue-and-groove joint.

6. An elongate cavity sealing profile in accordance with claims 2, 3 or 4, characterized in that the top surface of the horizontal limb of said profile is in the form of a ship-lap joint.

7. A method of construction thermally insulating cavity walls comprising A) inserting at the base of the cavity sealing profile of claim 2; B) inserting the edge of a thermal insulating board in the L-shaped portion of said profile; C) progressively constructing the inner and outer cavity walls while adding additional insulating boards until the desired height is obtained; and D) capping the upper edge of said insulating board with a second elongate sealing profile which is placed in opposition to the base profile.

8. A process according to claim 7 characterized in that the top face of said profile extends obliquely downwards from its inner longitudinal face to its outer longitudinal face.

9. A process according to claim 7 characterized in that said elongate sealing profile further comprises a moisture-proof, tear resistant, flexible film, which is fastened to the top face of the vertical limb of said profile, said film extending in both directions beyond the top face of said profile.

* * * * *